US006659001B2

(12) United States Patent
Toyama

(10) Patent No.: US 6,659,001 B2
(45) Date of Patent: Dec. 9, 2003

(54) ROLLER STAMP OF INK-EXUDING TYPE AND METHOD FOR MAKING THE SAME

(75) Inventor: Tetsuyuki Toyama, Gamagohri (JP)

(73) Assignee: Yamahachi Kemikaru Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 10/186,772

(22) Filed: Jul. 1, 2002

(65) Prior Publication Data

US 2003/0070568 A1 Apr. 17, 2003

(51) Int. Cl.[7] ..... B41F 17/00; B41J 27/00; B41J 1/60

(52) U.S. Cl. ..... 101/106; 101/108; 101/109; 101/110; 101/116; 101/328; 101/331; 101/375; 101/35

(58) Field of Search ..... 101/328, 116, 101/106, 109, 108, 110, 375, 35, 331

(56) References Cited

U.S. PATENT DOCUMENTS

| | | | | | |
|---|---|---|---|---|---|
| 4,090,442 | A | * | 5/1978 | Yazawa et al. | 101/111 |
| 4,152,980 | A | * | 5/1979 | Siegal | 101/35 |
| 5,505,133 | A | * | 4/1996 | Chen | 101/375 |
| 5,732,627 | A | * | 3/1998 | Imamaki | 101/328 |
| 6,360,658 | B1 | * | 3/2002 | Benson | 101/109 |

FOREIGN PATENT DOCUMENTS

| | | |
|---|---|---|
| JP | 2525132 | 8/1996 |

* cited by examiner

*Primary Examiner*—Andrew H. Hirshfeld
*Assistant Examiner*—Marvin P Crenshaw
(74) *Attorney, Agent, or Firm*—Price, Heneveld, Cooper, DeWitt & Litton

(57) ABSTRACT

A stamp of liquid-exuding type has a multiple-seal-faced assembly adapted for stamping with selected one of these multiple faces, preferably for stamping with multiple colors.

8 Claims, 14 Drawing Sheets

ROLLER STAMP OF INK-EXUDING TYPE AND METHOD FOR MAKING THE SAME

BACKGROUND OF THE INVENTION

Roller stamps of ink-exuding type are generally well known. Such roller stamps include a rotatably supported stamp roller of ink-exuding type that is adapted to be rolled on surface to thereby transfer letters, figures, numerals, symbols, photos or the like from the roller surface to the surface to be stamped. Known roller stamps have a mechanism to define the leading edge and trailing edges of the roller stamp so that the entire seal face of the roller stamp can be reliably transferred to the surface to be stamped. Known roller stamps can contribute to the protection of the environment relative to adhesive labels, and it is expected that such roller stamps will be widely used for this reason.

Various indications are necessary, for example, on corrugated cardboard shipping boxes, such as destination, article name, article number, bar codes, content description, and instruction for handling. Conventionally, these indications common to many corrugated cardboard boxes can be directly printed on the boxes. Such indications may include the destinations and the instructions for handling (e.g. "Fragile", "Don't Turn Over", "Don't Throw", "Don't Lay Down", etc.). Label seals protected by release paper have often been used for such applications. For such label seals, a large number of labels previously printed with various instructions are typically stored and an appropriate seal is then selected and affixed it to the box. Blank labels have usually been stamped or printed with the destination and then affixed to the box.

Release paper has generated troublesome refuse, and the operation of peeling the label seals off from the boxes for the purpose of reusing the used corrugated cardboard boxes requires time and labor. The label seals that have been peeled off also generate refuse and cause environmental problems.

The problems described above can be avoided by using a roller stamp to transfer various indications directly on the corrugated cardboard box without use of the label seals themselves. Troublesome operation of affixing and peeling off the label seals is not necessary, such that the operating cost is reduced, and generation of refuse is avoided. However, a flat stamp, it is difficult to stamp uniformly, particularly when the seal face is relatively large and a considerable force is necessary to achieve this. In contrast, roller stamps enable a distinct transfer to be carried out with a light touch since each cycle of stamping is completed by continuous line contacts as the roller stamp rotates through a 360° range.

SUMMARY OF THE INVENTION

The present invention provides a novel roller stamp of ink-exuding type including a simplified mechanism to define the position at which the transfer is started and ended. This invention also provides a simplified process for making such a roller stamp.

One aspect of the invention is a roller stamp of ink-exuding type comprising a stamp roller of ink-exuding type, a seal face on a cylindrical surface of said stamp roller. A ratchet wheel is provided on one end surface of said stamp roller so as to lie inside a peripheral wall of said stamp roller. The ratchet wheel has a locking recess adapted to define a position at which each cycle of stamping is started and completed, and a locking projection elastically biased to be engaged with said locking recess. A control mechanism is adapted to disengage said locking projection from said locking recess. The position at which the locking projection comes in engagement with the locking recess corresponds to the position at which each cycle of stamping is started and completed. With the locking projection disengaged from the locking recess, the roller is fully rotated and thereupon the locking projection comes into engagement with the locking recess again to stop further rotation of the roller. In this way, the seal face of the roller stamp can be accurately stamped on the object to be stamped.

The roller stamp of ink-exuding type according to the present invention further comprises a roller supporting cover frame rotatably supporting the stamp roller of ink-exuding type by its roller shaft supporting side plates and provided with an opened region in which the stamp roller is partially exposed. The locking projection and control mechanism are formed on one of the roller shaft supporting side plates. Operation of stamping can be easily carried out by merely manipulating the control mechanism with the roller supporting cover frame held in hand.

The roller supporting cover frame includes a cylindrical member having the opened region facing downward in which said stamp roller is partially exposed, and the roller shaft supporting side plates are detachably mounted on longitudinally opposite ends of the cylindrical member. The roller supporting cover frame has a cylindrical shape which facilitates the operation of stamping.

The roller shaft supporting side plate has the locking projection on its inner side. The locking projection is elastically biased downward, and the roller shaft supporting side plate is provided on its outer side with a control button adapted to move the locking projection upward and thereby disengage the locking projection from the locking recess of the ratchet wheel. The operation of stamping starting from the leading edge of the seal face and ending at the tail edge of the seal face can be reliably achieved by a single cycle of stamping.

The stamp roller of ink-exuding type comprises a cylindrical ink reservoir formed of thermoplastic synthetic resin and provided with a central shaft extending through respective central zones of its longitudinally opposite side walls. The stamp roller also includes a cylindrical seal face member formed of ink-permeable thermoplastic synthetic resin that is heat-sealable with the ink reservoir and fits around said ink reservoir. The ink reservoir and the seal face member are formed of the same type of the same material and a high workability for heat-sealing or the like is obtained.

The cylindrical ink reservoir includes a plurality of ink supplying through-holes on its peripheral wall. The ink reservoir may be filled with ink such that the roller stamp may be used for a long period without resupplying the reservoir with ink.

The longitudinally opposite end surfaces of the ink reservoir are heat-sealed with longitudinally opposite end surfaces of the seal face member. In this way, there is no risk that any quantity of ink might leak sideways from the ink reservoir or from the seal face member. One of the end walls of the ink reservoir includes an ink supplement through-hole. When the ink reservoir becomes short of ink, the reservoir can be supplemented with ink.

Another aspect of this invention is a process for making a roller stamp of ink-exuding type. The method includes the steps of molding material for the ink reservoir and ink-permeable material for the seal face member into long tubular stock materials using pipe-extruder. The tubular stock materials are cut to the same length to make each set of ink reservoir and seal face member for the stamp roller. In this way, it is possible to select a width of the seal face and thereby to reduce the manufacturing cost.

BRIEF DESCRIPTION OF THE DRAWINGS

FIG. 7;

FIG. 9;

DETAILED DESCRIPTION OF THE PREFERRED EMBODIMENTS

Figure 1:
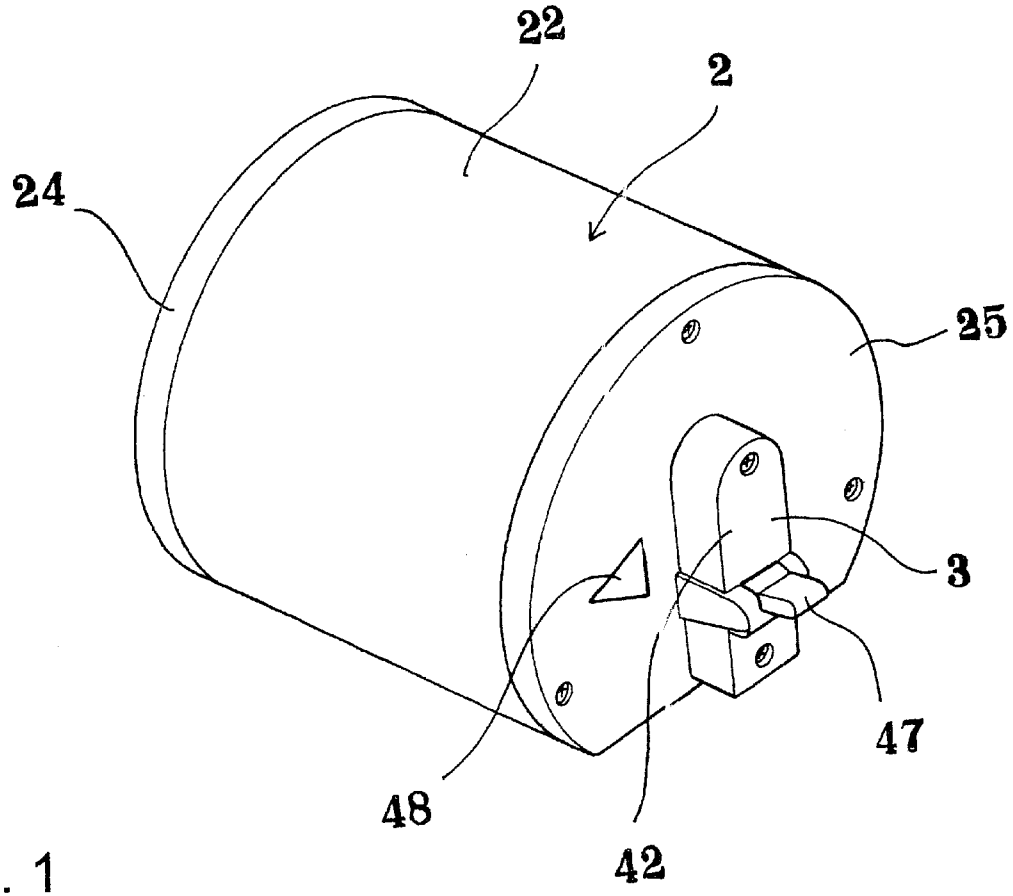
FIG. 1 is a perspective view showing a roller stamp of ink-exuding type according to the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
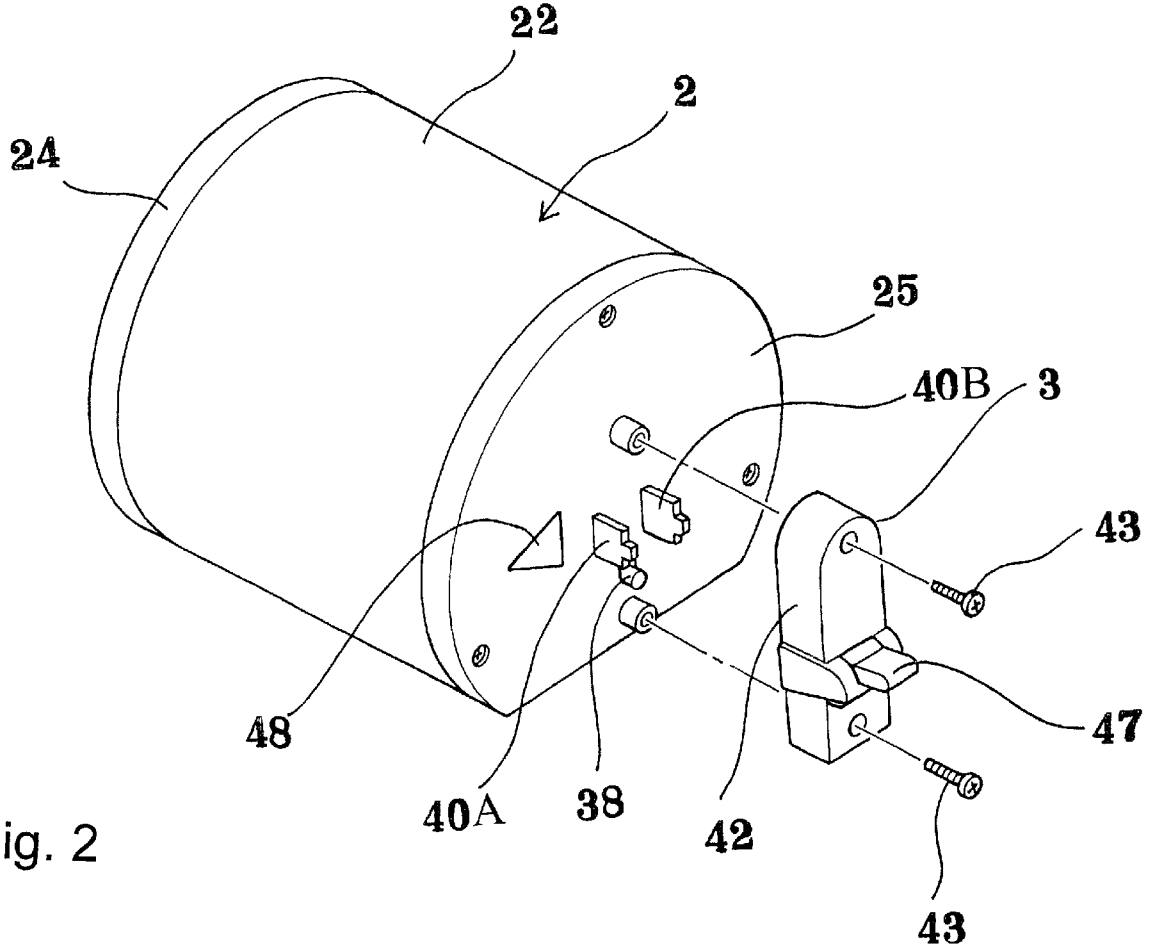
FIG. 2 is a partially exploded perspective view showing a roller stamp according to the present invention, wherein the outer portion of the control mechanism has been separated from the main body.
Figure 3:
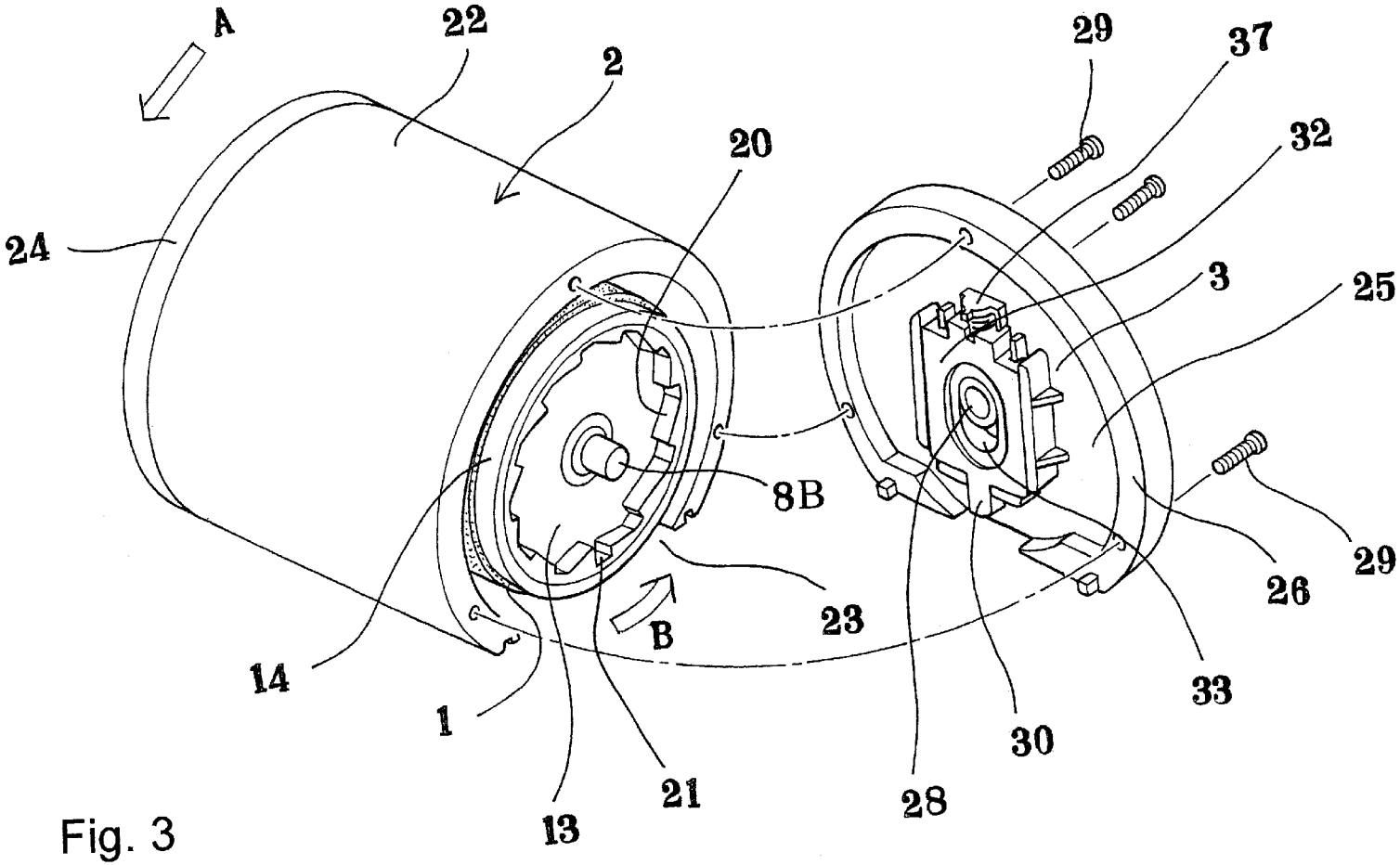
FIG. 3 is a partially exploded perspective view showing the operative relationship between the inner side of the control mechanism and the ratchet wheel.
Figure 4:
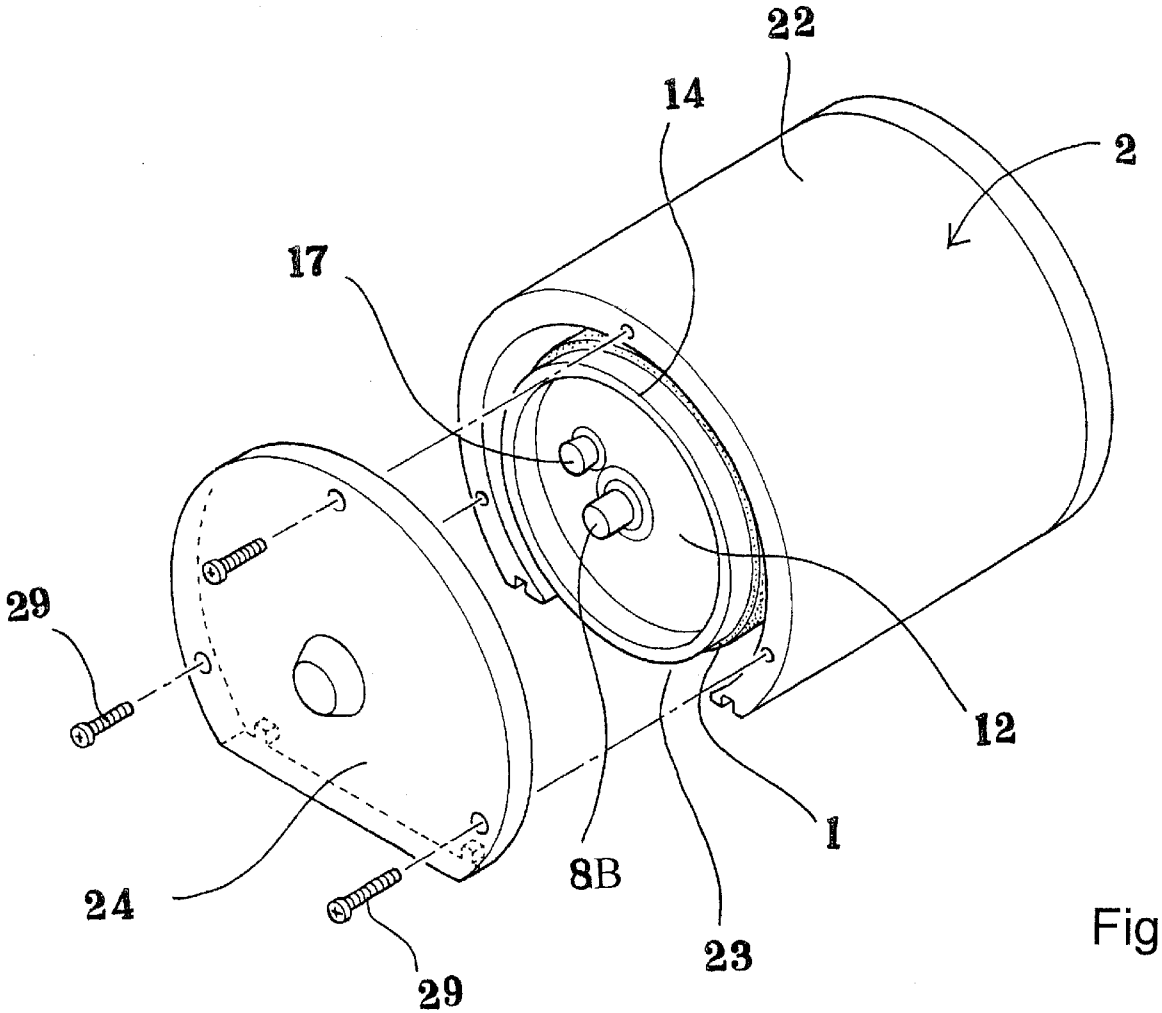
FIG. 4 is a partially exploded perspective view showing a roller stamp according to the present invention with the side plate opposite the control mechanism separated from the main body.

With reference to FIGS. 1–3, a roller-stamp 1 of ink exuding type according to the present invention includes a stamp roller 1 of ink-exuding type, and a roller supporting cover frame 2 rotatably supporting this stamp roller 1. The roller-stamp also includes a control mechanism 3 that ensures a full rotation of the stamp roller 1 starting from a leading edge and ending at a tail edge of its seal face for every cycle of stamping.

Figure 11:
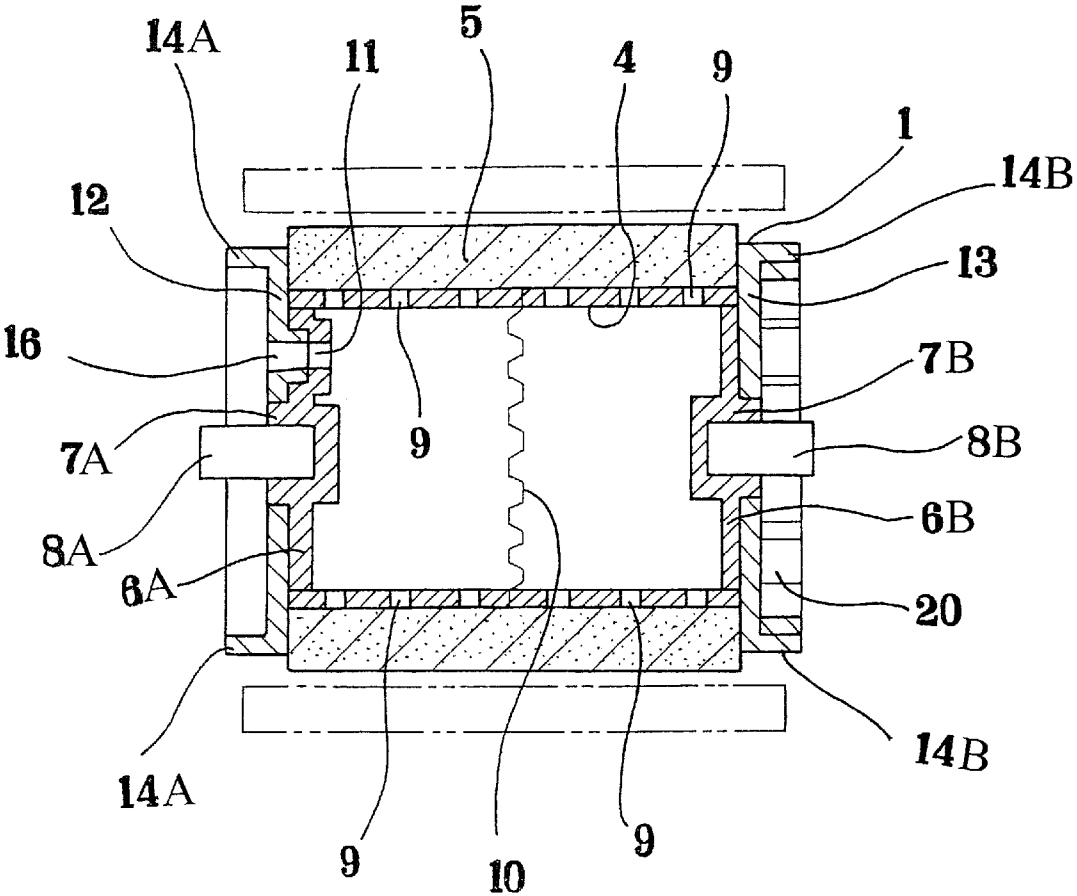
FIG. 11 is a sectional view showing the stamp roller.
Figure 12:
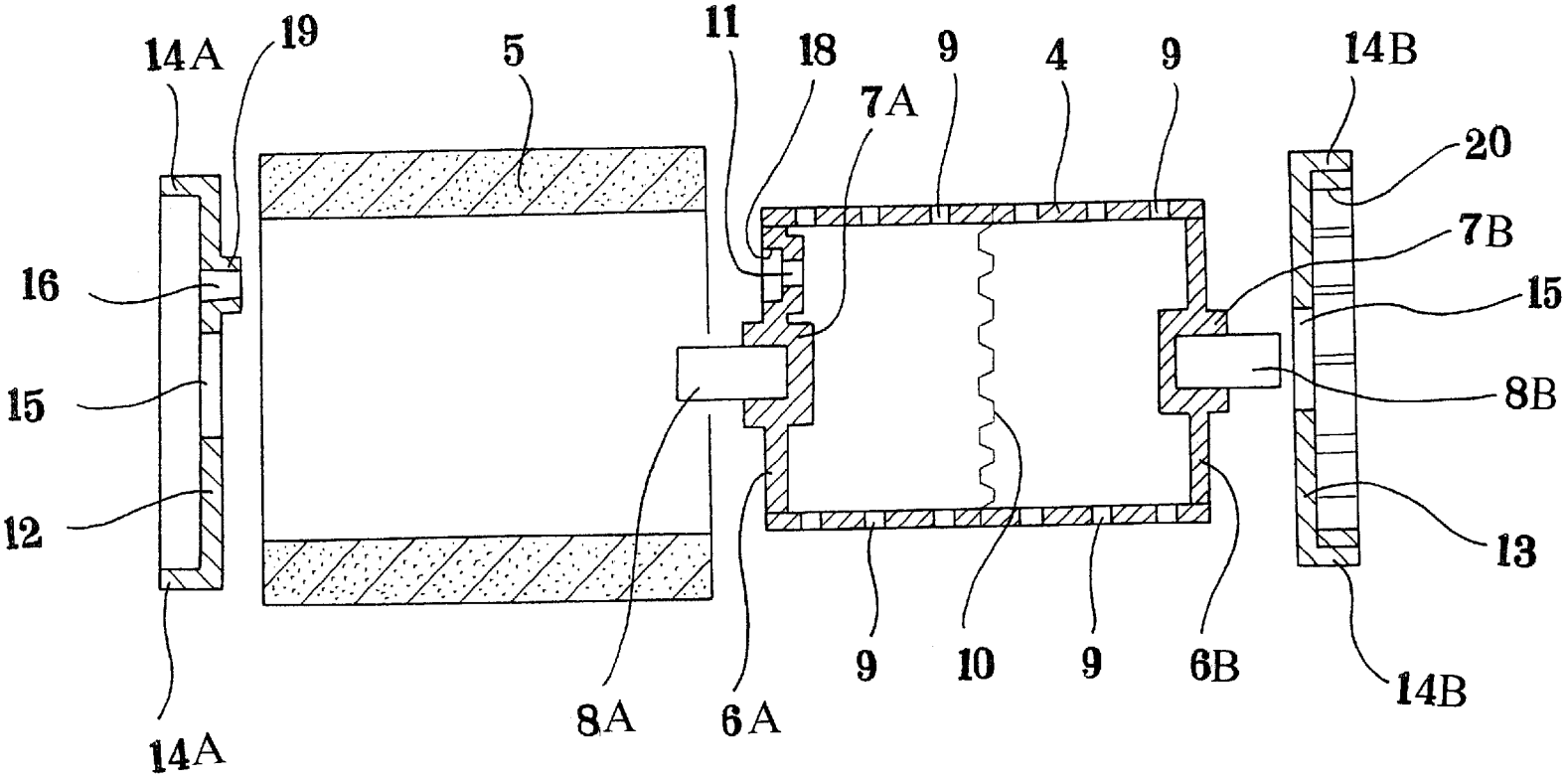
FIG. 12 is an exploded sectional view showing the stamp roller.
Figure 13:
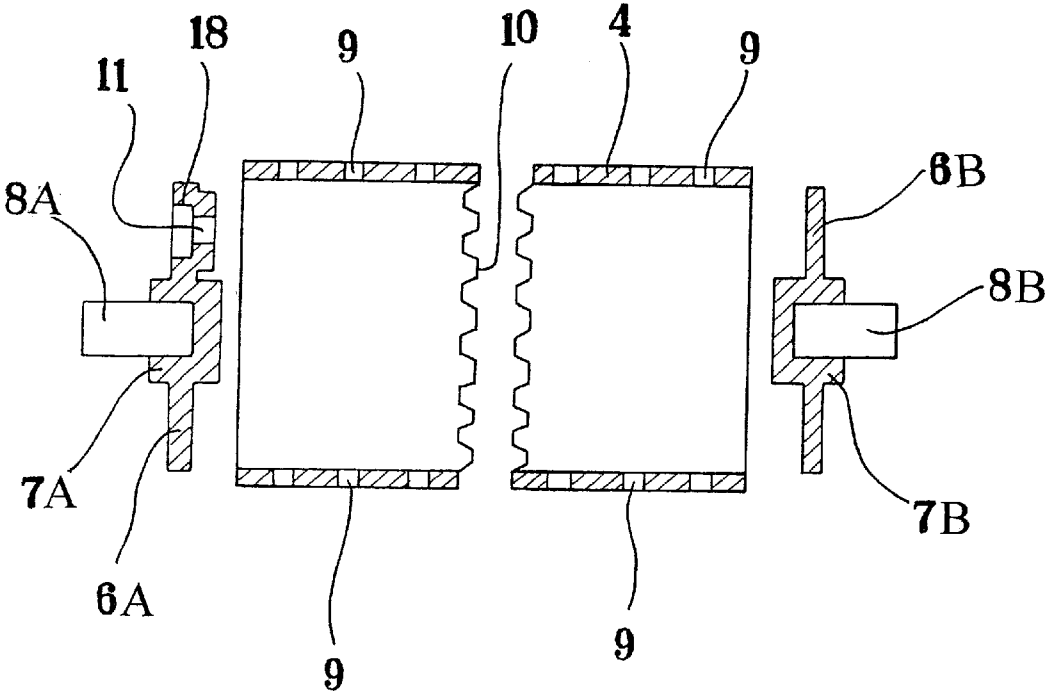
FIG. 13 is an exploded sectional view showing the ink reservoir.
Figure 14:
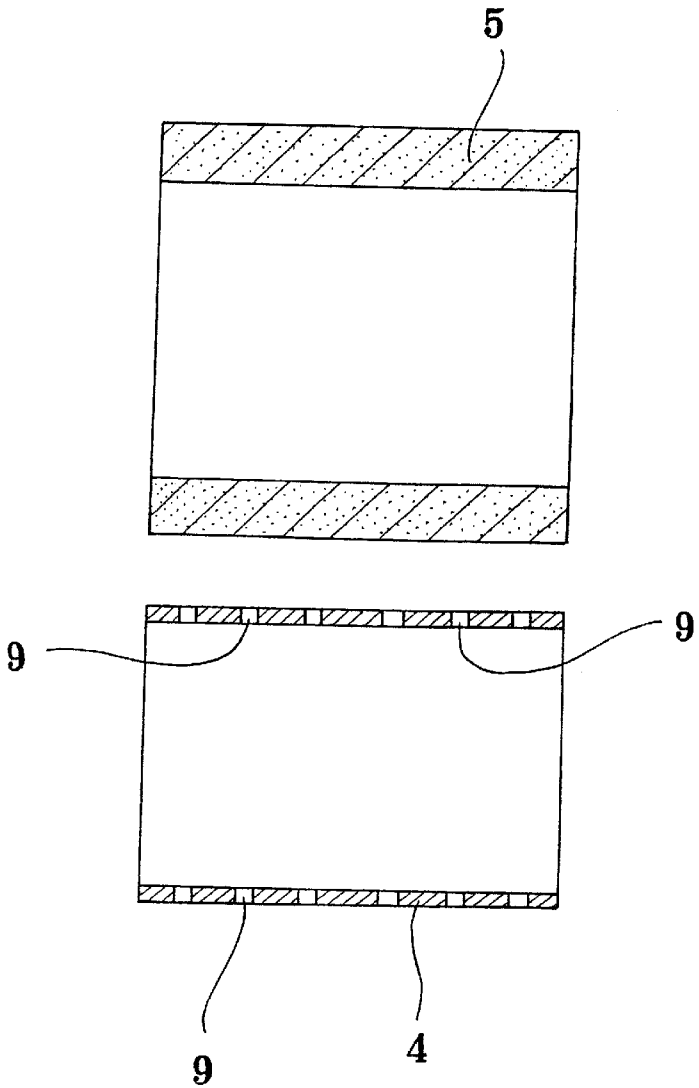
FIG. 14 is an exploded sectional view showing the cylindrical ink reservoir and the cylindrical seal face member.

With further reference to FIGS. 11 and 12, the stamp roller 1 of ink-exuding type includes a cylindrical ink reservoir 4 that is preferably formed of polyolefine-based thermoplastic synthetic resin and a cylindrical seal face member 5 formed of spongy material of thermoplastic synthetic resin heat-welded to the outer peripheral surface of the ink reservoir 4. Side plates 6A and 6B close the longitudinal opposite end openings of the cylindrical ink reservoir 4. The side plates 6A, 6B have central thick wall regions 7 protruding inwardly and outwardly with respect to the ink reservoir to define outwardly opening recesses. Central rotary shafts 8A and 8B are embedded in the recesses of wall regions 7, and extend outwardly therefrom. The peripheral surfaces of the ink reservoir 4 are formed with a plurality of through-holes 9 serving as ink passages through which the ink from the ink reservoir 4 exudes in the seal face member 5. Opposite surfaces of the ink reservoir 4 defined by the side plates 6A and 6B are flush with the opposite surfaces of the seal face member 5 and heat sealed with each other in order to avoid sideways leakage of ink from the sides of the stamp roller 1.

Although the cylindrical ink reservoir may be in the form of an integral cylinder, it is preferable to fabricate a complete cylinder by coupling two cylinder halves that were previously divided along a longitudinal middle zone 10. This permits the side plates 6A and 6B to be joined to the cylinder halves prior to coupling the cylinder halve to each other in a butt joint fashion in the middle zone 10. This arrangement provides improved fabrication compared to having the side plates 6A and 6B attached to a complete cylinder. Side plate 6A includes an ink supplement through-hole 11, and side plate 6B includes a ratchet wheel described in more detail below.

The stamp roller 1 including the ink reservoir 4 and the seal face member 5 integrally joined as described above is then provided with side wall covers 12, 13 at its opposite sides. Each of the side wall covers 12, 13 is a disc-like member having a square U-shaped cross-section defining shallow peripheral walls 14A and 14B. The side wall covers 12 and 13 include central through-holes 15A and 15B that are adapted to receive the thick wall regions 7A and 7B of the side plates 6A and 6B, respectively of the ink reservoir 4. The covers 12 and 13 are thereby attached to the sides of the stamp roller 1 with the peripheral walls 14A and 14B thereof opening outward.

The side wall over 12 attached to the side plate 6A includes a through-hole 16 in alignment with the through-hole 11 to provide for ink supplement. A stopper 17 normally blocks the through-hole 16. To align these ink supplement through-holes 11 and 16 with each other, the side plate 6 includes a recess 18 and the side wall cover 12 includes a protuberance 19 extending inward. The protuberance 19 can be engaged with the recess 18 to achieve the desired alignment.

Side wall cover 13 includes a ratchet wheel inside its peripheral wall 14B. As described in more detail below, ratchet wheel 20 includes a locking recess 21 adapted to cooperate with a locking projection of the control mechanism 3 to achieve positioning and ensure a full rotation of the stamp roller 1 starting from the leading edge and ending at the tail edge of the seal face.

With reference to FIG. 3, the roller supporting cover frame 2 includes a main body 22 formed by partially cutting away a cylinder having a diameter larger than that of the stamp roller 1 to define an open region 23 in which the stamp roller 1 is partially exposed and a pair of roller shaft supporting side plates 24 and 25 adapted to close the open ends of main body 22. The roller shaft supporting side plates 24 and 25 are planar plates having substantially the same shape as the cross-sectional shape of the main body 22. The roller shaft supporting side plates 24 and 25 each have a rim 26 along the peripheral edge that extends inward. Rims 26 are formed in a region corresponding to the central region of the cylinder having an associated bearing 27 or 28. The central rotary shafts 8A and 8B are rotatably supported by bearings 27 and 28. The roller shaft supporting side plates 24 and 25 are fixed to the periphery of main body 22 by screws 29. In this state, the stamp roller 1 is rotatably supported by the roller supporting cover frame 2 so that the stamp roller 1 may be partially exposed in the open region 23 of the roller supporting cover frame 2. The bearing 28 comprises an inwardly extending short sleeve on the side plate 25. As described in more detail below, bearing 28 slidably supports a locking projection of the control mechanism 3.

Figure 5:
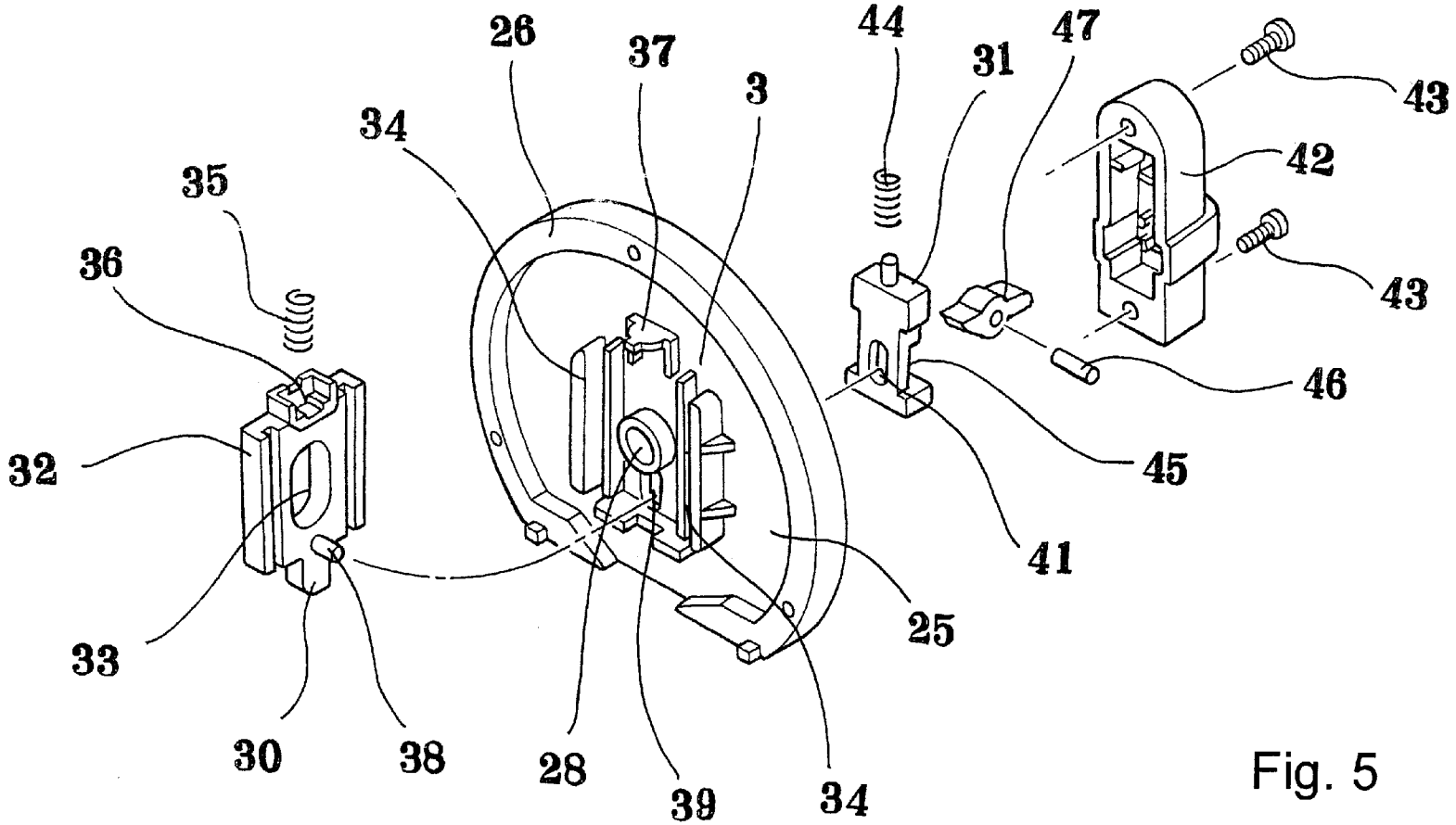
FIG. 5 is an exploded perspective view showing the control mechanism of the roller stamp according to the present invention.
Figure 6:
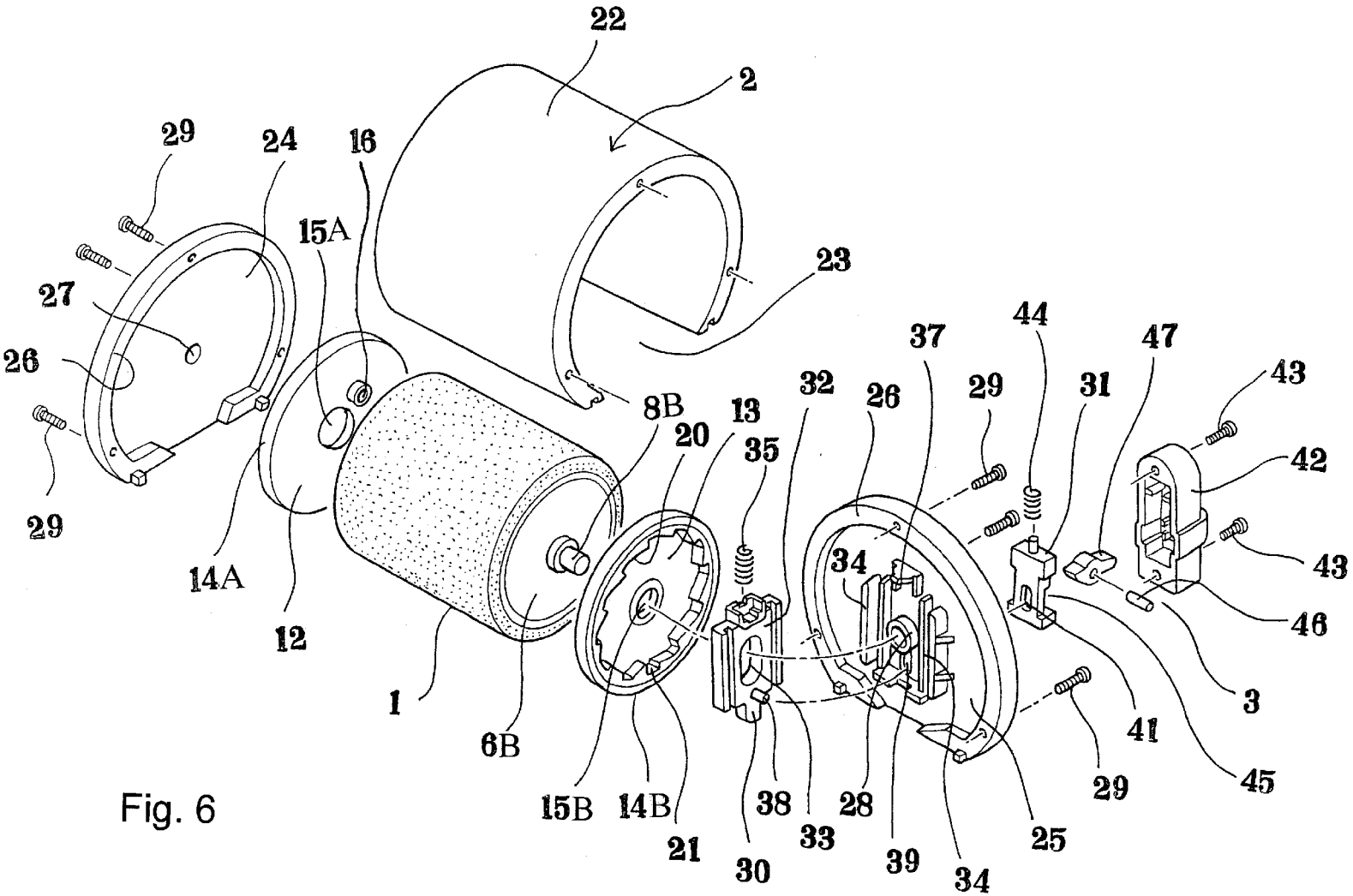
FIG. 6 is an exploded perspective view showing the entire roller stamp of the present invention.

The control mechanism 3 is incorporated in the roller shaft supporting plate 25 on the side of the stamp roller 1 including the ratchet wheel 20. The mechanism 3 includes locking projection 30 on the inside of side plate 25, and a control member 31 (see also FIG. 5) mounted on the outer side of side plate 25 to actuate the locking projection 30. The locking projection 30 extends downward from an actuator plate 32 having a longitudinal central slit 33 adapted to receive the sleeve-shaped bearing 28. The actuator plate 32 is slidably guided in vertical direction along guide members 34 projecting from the inner side of side plate 25. Actuator plate 23 is biased downwardly by a spring 35. Spring 35 is disposed between a spring seat 36 on an upper part of the actuator plate 32 and a spring seat 37 mounted on side plate 25.

The actuator plate 32 includes an outwardly projecting actuator pin 38. Actuator pin 38 extends outward through a longitudinal slit 39 in side plate 25. The control member 31 is supported by a pair of guide projections 40A and 40B on the outer surface of side plate 25 for vertical movement of control member 31. Control member 31 includes a locking slit 41 adapted to receive and thereby lock the actuator pin 38 extending outward through the slit 39 of the side plate 25. The control member 31 is covered with a cover plate 42 that is detachably secured to the outer surface of the side plate 25 by screws 43. The control member 31 is vertically movable within the cover member 42 and is biased downwardly by a spring 44.

The control member 31 includes a locking recess 45 on its outer side adapted to receive and lock an engaging end of a control button 47 supported within the cover member 42 by a pin 46. The engaging end of the control button 47 may be engaged with the locking recess 45, and the end of the control button 47 projecting outward through the cover member 42 may be depressed to move the control member 31, and thereby to move the actuator pin 38 in engagement with the locking slit 41 upward. Thus, the actuator plate 32 and its locking projection 30 are moved upward. Reference numeral 48 (FIG. 1) designates the direction in which a roller stamp according to this invention is actuated and moved.

Figure 7:
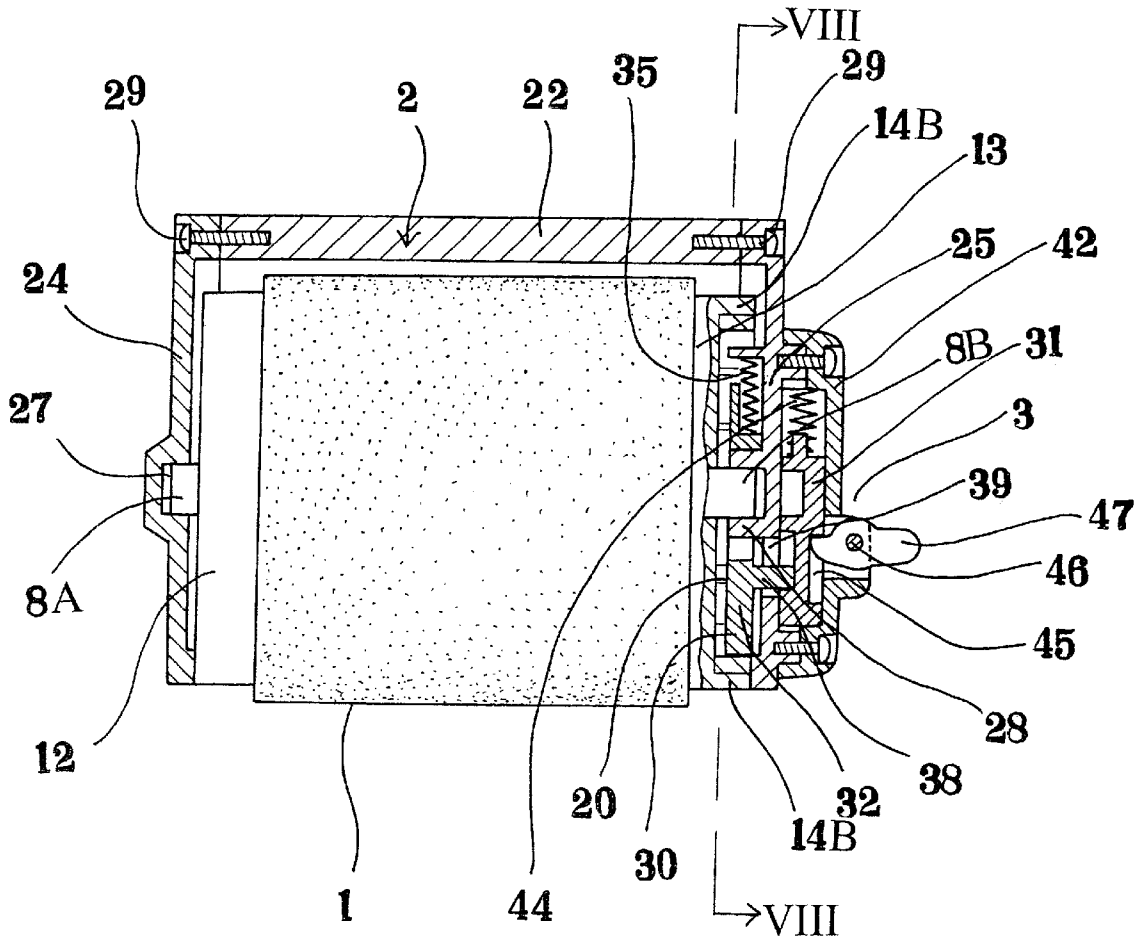
FIG. 7 is a sectional view showing the roller stamp of the present invention wherein the locking projection of the control mechanism is in engagement with the locking recess of the ratchet wheel for positioning of the leading edge of the seal face member.
Figure 8:
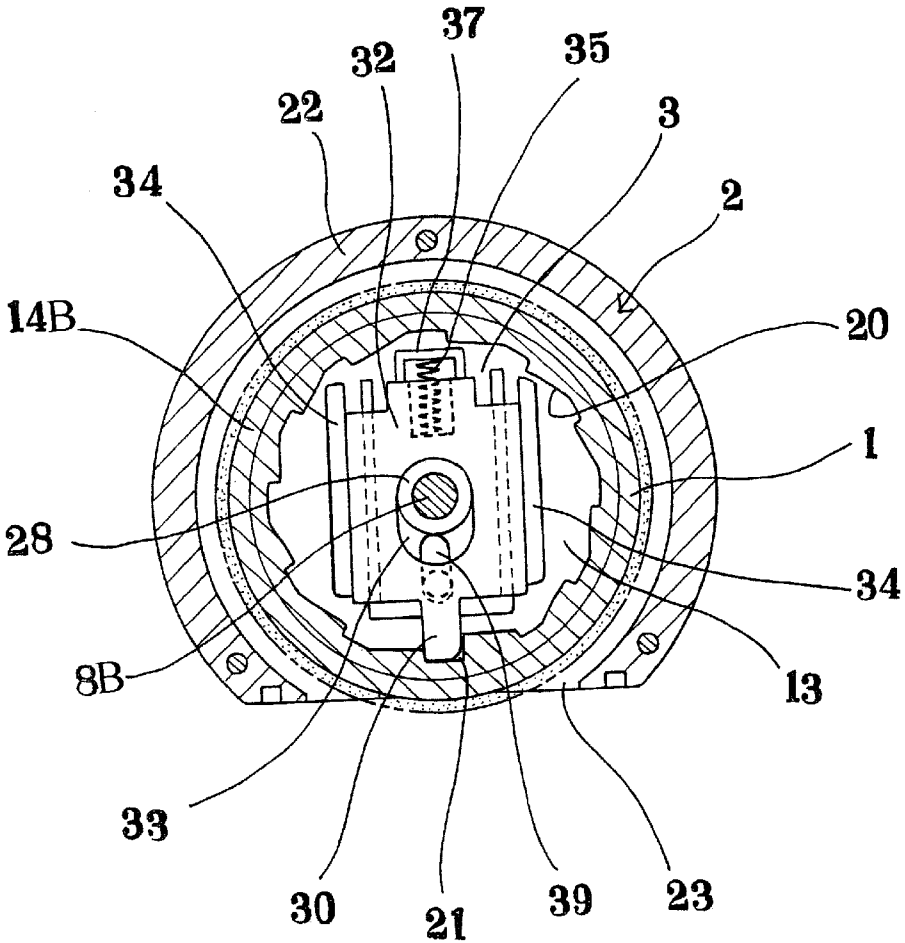
FIG. 8 is a sectional view taken along the line VIII—VIII.

The roller stamp of ink-exuding type according to this invention as described above is normally in a state wherein the locking projection 30 of the control mechanism is in engagement with the locking recess 21 of the ratchet wheel 20. This state is shown in FIGS. 7 and 8, in which the roller stamp 1 according to this invention is ready to start a cycle of stamping from the leading edge of the seal face.

Figure 9:
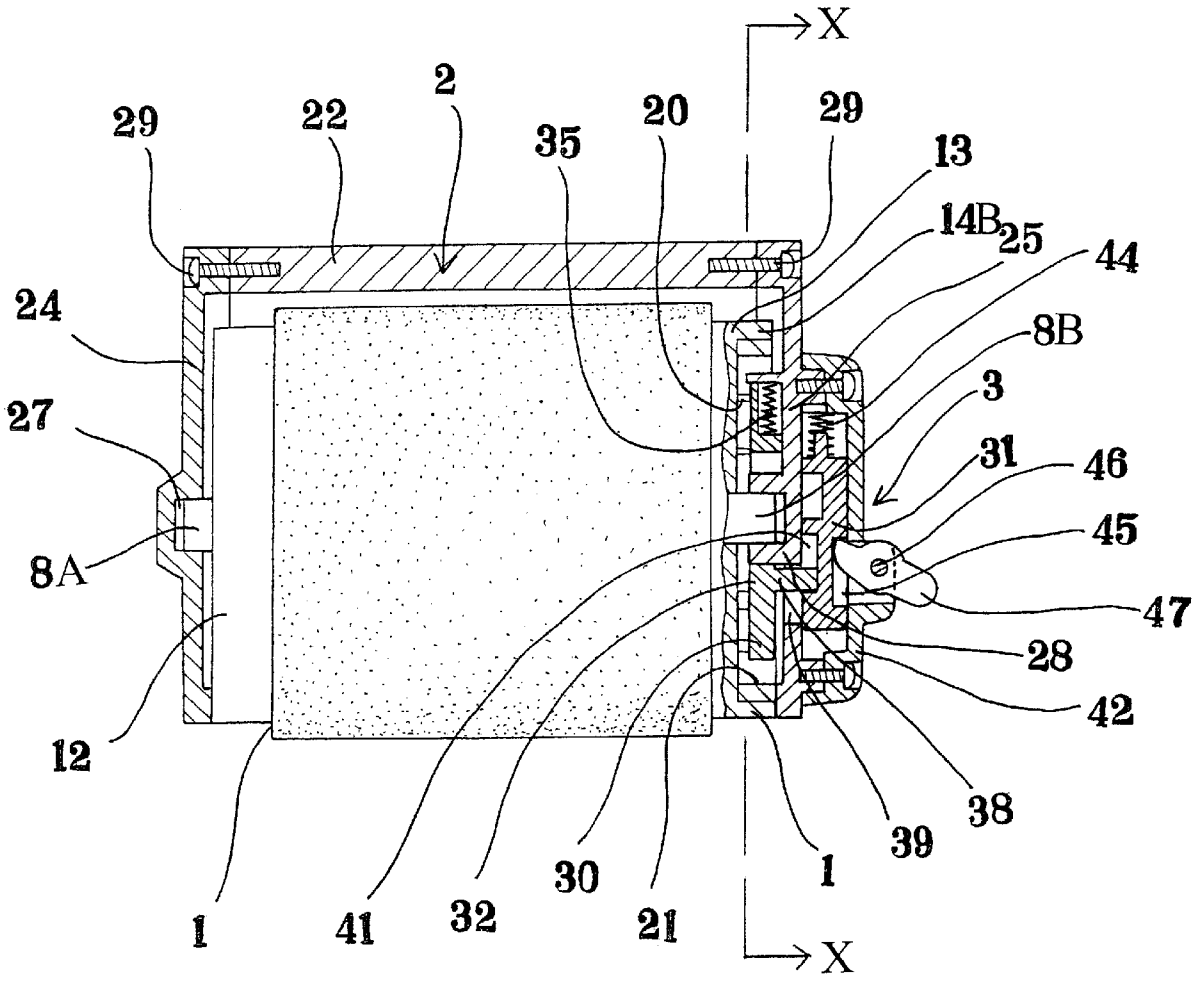
FIG. 9 is a sectional view showing the roller stamp of the present invention wherein the locking projection of the control mechanism is out of engagement with the ratchet wheel.

During operation, the cover frame 2 is held, and the exposed part of the stamp roller 1 exposed in the opened region is pressed against a surface to be stamped, and the control button 47 of the control mechanism 3 is depressed. The engaging end of control button 47 moves the control member 31 upward, and control member 31 moves the actuator plate 32 by means of the actuator pin 38. The locking projection 30 is thereby moved upward and disengaged from the locking recess 21 of the ratchet wheel 20 as illustrated in FIGS. 9 and 10.

Figure 10:
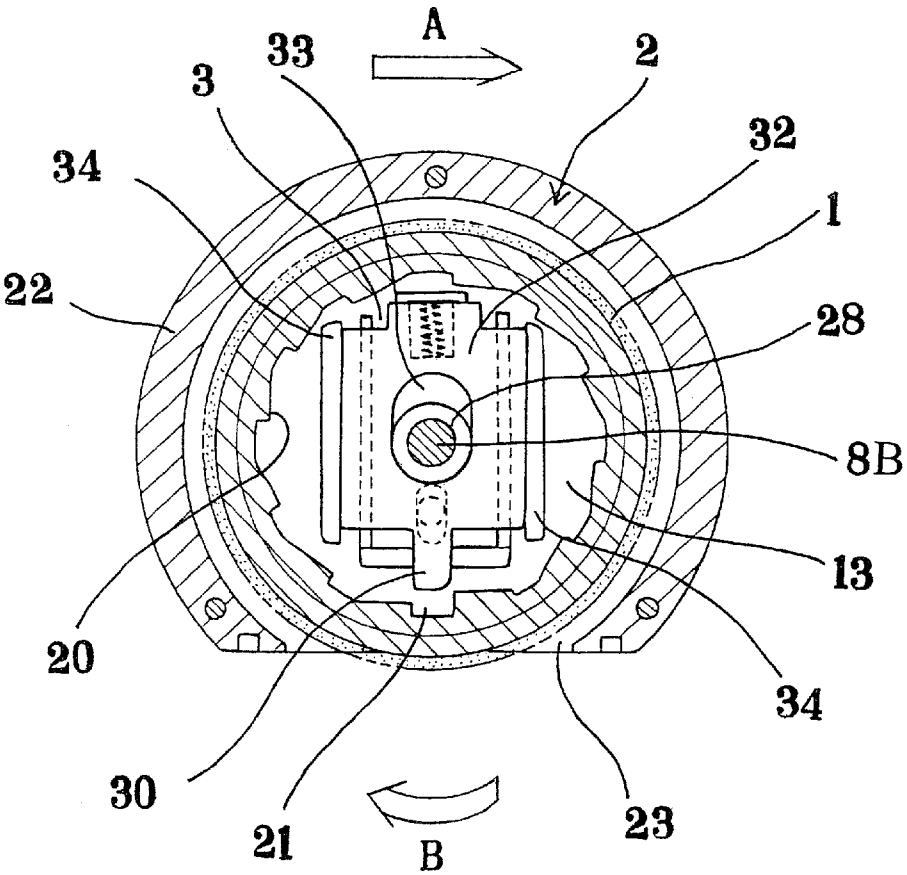
FIG. 10 is a sectional view taken along the line X—X.

From this state, the roller stamp 1 may be moved in the direction of arrow 48 (arrow A in FIG. 10) marked on side plate 25 of the cover frame 2 to roll the stamp roller 1 clockwise as viewed in FIG. 10. When the control button 47 is relieved from a depressing force, the locking projection 30 is pressed against the ratchet wheel 20 by the spring 35. However, the stamp roller 1 is not prevented from smoothly rolling. Upon completion of a full rolling of the stamp roller 1, the engaging projection 30 comes into engagement with the locking recess 21 and the stamp roller 1 stops rolling. Each stamping cycle is completed in this manner.

During fabrication, material for the ink reservoir 4 and ink-permeable material for the seal face member 5 constituting the stamp roller 1 are molded into long tubular stock materials using a pipe-extruder. These tubular stock materials are cut to the proper length to make the ink reservoir 4 and seal face member 5 for the stamp roller.

Through-holes 9 are formed in the ink reservoir 4, and the cylindrical ink reservoir 4 is then fit in the cylindrical seal face member 5 until the longitudinal end surfaces of these cylindrical components 4 and 5 become flush with each other, such that components 4 and 5 become integral. The side walls 6A and 6B are inserted into the ink-reservoir against its inner peripheral edges, and thereafter joint surfaces of these side walls, ink reservoir and seal face member are integrally heat sealed to prevent ink from leaking sideways.

What is claimed is:

1. A roller stamp of ink-exuding type comprising:

a stamp roller of ink-exuding type, said stamp roller defining a cylindrical surface, an end surface, and a peripheral wall;

a seal face on said cylindrical surface of said stamp roller;

a ratchet wheel disposed adjacent the end surface of said stamp roller at least partially inside said peripheral wall of said stamp roller, said ratchet wheel having a locking recess adapted to define a position at which each stamping cycle is started and completed;

a locking projection elastically biased into engagement with said locking recess; and a control mechanism adapted to disengage said locking projection from said locking recess.

2. The roller stamp of claim 1, wherein:

said stamp roller further includes first and second roller shaft supporting side plates at opposite ends of said stamp roller; and including:

a roller supporting cover frame rotatably supporting said stamp roller of ink-exuding type by said roller shaft supporting side plates, said cover frame having an open region in which said stamp roller is at least partially exposed, and wherein said locking projection and control mechanism are provided on said first roller shaft supporting side plates.

3. The roller stamp of claim 2, wherein:

said roller supporting cover frame comprises a cylindrical member defining opposite ends and having said open region facing downward when in a position for use, and wherein said roller shaft supporting side plates are detachably mounted on said opposite ends of said cylindrical member.

4. The roller stamp of claim 2, wherein:

said first roller shaft supporting side plate includes said locking projection elastically biased downward on its inner side;

said first roller shaft supporting side plate including a control button on its outer side adapted to move said locking projection upward and thereby disengage said locking projection from said locking recess of said ratchet wheel.

5. The roller stamp of claim 4, wherein:

said stamp roller of ink-exuding type comprises a cylindrical ink reservoir formed of thermoplastic synthetic resin and includes a central shaft extending through respective central zones of said opposite side walls and a cylindrical seal face member formed of ink-permeable thermoplastic synthetic resin that is heat-sealable with said ink reservoir and fits around said ink reservoir.

6. The roller stamp of claim 5, wherein:

said peripheral wall of said cylindrical ink reservoir includes a plurality of ink supplying through-holes.

7. The roller stamp of claim 6, wherein:

said opposite end surfaces of said ink reservoir are heat-sealed with opposite end surfaces of said seal face member.

8. The roller stamp of claim 7, wherein:

said ink reservoir includes an ink supplement through-hole on a selected one of its end walls.

* * * * *